US008148307B2

(12) United States Patent
Kocsis et al.

(10) Patent No.: US 8,148,307 B2
(45) **Date of Patent: *Apr. 3, 2012**

(54) TARTARIC ACID DERIVATIVES AS FUEL ECONOMY IMPROVERS AND ANTIWEAR AGENTS IN CRANKCASE OILS AND PREPARATIONS THEREOF

(75) Inventors: Jody Kocsis, Chagrin Falls, OH (US); Jonathan S. Vilardo, Chardon, OH (US); Jason R. Brown, North Ridgeville, OH (US); Daniel E. Barrer, Richmond Heights, OH (US); Richard J. Vickerman, Stow, OH (US); Patrick E. Mosier, Bay Village, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/768,866

(22) Filed: May 17, 2010

(65) Prior Publication Data

US 2010/0222245 A1 Sep. 2, 2010

Related U.S. Application Data

(62) Division of application No. 11/348,031, filed on Feb. 6, 2006, now Pat. No. 7,807,611.

(51) Int. Cl.
*C10M 129/95* (2006.01)

(52) U.S. Cl. ..... 508/465; 508/506

(58) Field of Classification Search ..... 508/506, 508/583, 465

See application file for complete search history.

(56) References Cited

U.S. PATENT DOCUMENTS

| | | | | |
|---|---|---|---|---|
| 2,365,291 | A | 12/1944 | Prutton et al. | |
| 2,417,281 | A | 3/1947 | Wasson et al. | |
| 2,443,578 | A | 6/1948 | Fuller et al. | |
| 2,715,108 | A | 8/1955 | Francis | |
| 2,977,309 | A * | 3/1961 | Godfrey et al. | 508/454 |
| 3,785,975 | A | 1/1974 | Humphrey et al. | |
| 4,175,047 | A | 11/1979 | Schick et al. | |
| 4,237,022 | A | 12/1980 | Barrer | |
| 4,304,678 | A | 12/1981 | Schick et al. | |
| 4,326,972 | A | 4/1982 | Chamberlin, III | |
| 4,478,604 | A | 10/1984 | Schuettenberg | |
| 4,640,787 | A | 2/1987 | Schuettenberg | |
| 4,692,257 | A | 9/1987 | Horodysky | |
| 4,741,848 | A | 5/1988 | Koch et al. | |
| 4,952,328 | A | 8/1990 | Davis et al. | |
| 5,338,470 | A | 8/1994 | Hiebert et al. | |
| 5,387,351 | A | 2/1995 | Kumar et al. | |
| 5,484,543 | A | 1/1996 | Chandler et al. | |
| 6,818,601 | B1 | 11/2004 | Lange | |
| 7,651,987 | B2 * | 1/2010 | Kocsis et al. | 508/506 |
| 7,807,611 | B2 * | 10/2010 | Kocsis et al. | 508/506 |
| 2003/0134754 | A1 * | 7/2003 | Kelley | 508/287 |
| 2003/0195128 | A1 * | 10/2003 | Deckman et al. | 508/591 |
| 2004/0010966 | A1 | 1/2004 | Aradi et al. | |
| 2005/0107269 | A1 | 5/2005 | Yagishita et al. | |
| 2005/0198894 | A1 | 9/2005 | Migdal et al. | |

FOREIGN PATENT DOCUMENTS

| | | |
|---|---|---|
| GB | 2105743 A1 | 3/1983 |
| WO | 2004/003117 | 1/2004 |

OTHER PUBLICATIONS

Search Report corresponding International Publication No. 2007/092724 A3 dated Sep. 27, 2007.

* cited by examiner

*Primary Examiner* — Walter D Griffin
*Assistant Examiner* — Taiwo Oladapo
(74) *Attorney, Agent, or Firm* — Christopher D. Hilker; David M. Shold

(57) ABSTRACT

Formulations using tartaric compounds of the present invention in a low sulfur, low ash and low phosphorous lubricant lower wear, and friction and improves fuel economy.

30 Claims, No Drawings

TARTARIC ACID DERIVATIVES AS FUEL ECONOMY IMPROVERS AND ANTIWEAR AGENTS IN CRANKCASE OILS AND PREPARATIONS THEREOF

CROSSREFERENCE TO PRIOR APPLICATION

This is a divisional of copending application U.S. Ser. No. 11/348,031 filed on Feb. 6, 2006.

BACKGROUND OF THE INVENTION

The present invention relates to a low sulfur, low ash, low phosphorous lubricant composition and method for lubricating an internal combustion engine, providing improved fuel economy and retention of fuel economy and wear and friction reduction.

Fuel economy is of great importance, and lubricants which can foster improved fuel economy by, for instance, reducing friction within an engine, are of significant value. The present invention provides a low sulfur, low ash, low phosphorous lubricant composition, including an additive package, which leads to improved fuel economy in an internal combustion engine. This improvement is effected by providing an additive package in which the friction modifier component is exclusively or predominantly a tartrimide or a tartramide or combinations thereof.

U.S. Pat. No. 4,237,022, Barrer, Dec. 2, 1980, discloses tartrimides useful as additives in lubricants and fuels for effective reduction in squeal and friction as well as improvement in fuel economy.

U.S. Pat. No. 4,952,328, Davis et al., Aug. 28, 1990, discloses lubricating oil compositions for internal combustion engines, comprising (A) oil of lubricating viscosity, (B) a carboxylic derivative produced by reacting a succinic acylating agent with certain amines, and (C) a basic alkali metal salt of sulfonic or carboxylic acid. An illustrative lubricant composition (Lubricant III) includes base oil including viscosity index modifier; a basic magnesium alkylated benzene sulfonate; an overbased sodium alkylbenzene sulfonate; a basic calcium alkylated benzene sulfonate; succinimide dispersant; and zinc salts of a phosphorodithioic acids.

U.S. Pat. No. 4,326,972, Chamberlin, Apr. 27, 1982, discloses lubricant compositions for improving fuel economy of internal combustion engines. The composition includes a specific sulfurized composition (based on an ester of a carboxylic acid) and a basic alkali metal sulfonate. Additional ingredients may include at least one oil-dispersible detergent or dispersant, a viscosity improving agent, and a specific salt of a phosphorus acid.

SUMMARY OF THE INVENTION

The present invention provides a low-sulfur, low-phosphorus, low-ash lubricant composition suitable for lubricating an internal combustion engine, comprising the following components:

(a) an oil of lubricating viscosity, and (b) a condensation product of a material represented by formula I and an alcohol or amine having 1 to about 150 carbon atoms and combinations thereof;

I

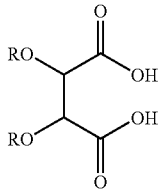

wherein each R is independently H or a hydrocarbyl group, or wherein the R groups together form a ring; and wherein if R is H, the condensation product is optionally further functionalized by acylation or reaction with a boron compound;

wherein said lubricant composition has a sulfated ash value of up to about 1.0, a phosphorus content of up to about 0.08 percent by weight and a sulfur content of up to about 0.4 percent by weight.

It further provides a method of lubricating an internal combustion engine, comprising supplying the lubricant composition to the engine.

DETAILED DESCRIPTION OF THE INVENTION

Various preferred features and embodiments will be described below by way of non-limiting illustration.

The present invention provides a composition as described above. Often the composition has total sulfur content in one aspect below 0.4 percent by weight, in another aspect below 0.3 percent by weight, in yet another aspect 0.2 percent by weight or less and in yet another aspect 0.1 percent by weight or less. Often the major source of sulfur in the composition of the invention is derived from conventional diluent oil. A typical range for the total sulfur content is 0.1 to 0.01 percent by weight.

Often the composition has a total phosphorus content of less than or equal to 800 ppm, in another aspect equal to or less than 500 ppm, in yet another aspect equal to or less than 300 ppm, in yet another aspect equal to or less than 200 ppm and in yet another aspect equal to or less than 100 ppm of the composition. A typical range for the total phosphorus content is 500 to 100 ppm.

Often the composition has a total sulfated ash content as determined by ASTM D-874 of below 1.0 percent by weight, in one aspect equal to or less than 0.7 percent by weight, in yet another aspect equal to or less than 0.4 percent by weight, in yet another aspect equal to or less than 0.3 percent by weight and in yet another aspect equal to or less than 0.05 percent by weight of the composition. A typical range for the total sulfate ash content is 0.7 to 0.05 percent by weight.

Oil of Lubricating Viscosity

The low-sulfur, low-phosphorus, low-ash lubricating oil composition is comprised of one or more base oils which are generally present in a major amount (i.e. an amount greater than about 50 percent by weight). Generally, the base oil is present in an amount greater than about 60 percent, or greater than about 70 percent, or greater than about 80 percent by weight of the lubricating oil composition. The base oil sulfur content is typically less than 0.2 percent by weight.

The low-sulfur, low-phosphorus, low-ash lubricating oil composition may have a viscosity of up to about 16.3 $mm^2/s$ at 100° C., and in one embodiment 5 to 16.3 $mm^2/s$ (cSt) at 100° C., and in one embodiment 6 to 13 $mm^2/s$ (cSt) at 100° C. In one embodiment, the lubricating oil composition has an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40 or 10W-50.

The low-sulfur, low-phosphorus, low-ash lubricating oil composition may have a high-temperature/high-shear viscosity at 150° C. as measured by the procedure in ASTM D4683 of up to 4 $mm^2/s$ (cSt), and in one embodiment up to 3.7 $mm^2/s$ (cSt), and in one embodiment 2 to 4 $mm^2/s$ (cSt), and in one embodiment 2.2 to 3.7 $mm^2/s$ (cSt), and in one embodiment 2.7 to 3.5 $mm^2/s$ (cSt).

The base oil used in the low-sulfur low-phosphorus, low-ash lubricant composition may be a natural oil, synthetic oil or mixture thereof, provided the sulfur content of such oil does not exceed the above-indicated sulfur concentration limit required for the inventive low-sulfur, low-phosphorus, low-ash lubricating oil composition. The natural oils that are useful include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils derived from coal or shale are also useful. Synthetic lubricating oils include hydrocarbon oils such as polymerized and interpolymerized olefins (e.g., polybutylenes, polypropylenes, propylene isobutylene copolymers, etc.); poly(1-hexenes), poly-(1-octenes), poly (1-decenes), etc. and mixtures thereof; alkylbenzenes (e.g., dodecylbenzenes, tetradecylbenzenes, dinonylbenzenes, di-(2-ethylhexyl)benzenes, etc.); polyphenyls (e.g., biphenyls, terphenyls, alkylated polyphenyls, etc.); alkylated diphenyl ethers and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed C3-8 fatty acid esters, or the carboxylic acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from C5 to C12 monocarboxylic acids and polyols and polyol ethers such as neopentyl glycol, trimethylol propane, pentaerythritol, dipentaerythritol, tripentaerythritol, etc.

The oil can be a poly-alpha-olefin (PAO). Typically, the PAOs are derived from monomers having from 4 to 30, or from 4 to 20, or from 6 to 16 carbon atoms. Examples of useful PAOs include those derived from octene, decene, mixtures thereof, and the like. These PAOs may have a viscosity from 2 to 15, or from 3 to 12, or from 4 to 8 $mm^2/s$ (cSt), at 100° C. Examples of useful PAOs include 4 $mm^2/s$ (cSt) at 100° C. poly-alpha-olefins, 6 $mm^2/s$ (cSt) at 100° C. poly-alpha-olefins, and mixtures thereof. Mixtures of mineral oil with one or more of the foregoing PAOs may be used.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Additionally, oils prepared by a Fischer-Tropsch gas to liquid synthetic procedure are known and can be used.

Friction Modifier

The tartrates, tartrimides, tartramides or combinations thereof of the present invention can be prepared by the reaction of tartaric acid and one or more alcohols or amines. The amines, for example, may have the formula RR'NH wherein R and R' each independently represent H, a hydrocarbon-based radical of 1 or 8 to 30 or to 150 carbon atoms, that is, 1-150 or 8-30 or 1-30 or 8-150 atoms. Other amines may be employed within a range having a lower carbon number of 2, 3, 4, 6, 10, or 12 carbon atoms and an upper carbon number of 120, 80, 48, 24, 20, 18, or 16 carbon atoms. In one embodiment, each of the groups R and R' has 8 to 30 carbon atoms. In one embodiment, the sum of carbon atoms in R and R' is at least 8. The substituent R and R' may also be —R"OR'" in which R" is a divalent alkylene radical of 2 to 6 carbon atoms and R'" is a hydrocarbyl radical of 5 to 150 or to 148 or to 146 or to 144 carbon atoms.

Amines suitable for the present tartrimide, tartramides or combinations thereof include those represented by the formula or RR'NH wherein R and R' represent H or a hydrocarbyl radical of 1 to 150 carbon atoms provided that, in certain embodiments, the sum of the carbon atoms in R and R' is at least 8. In one embodiment R or R' contain 8 to 26 carbons and in another embodiment from 12 to 18 carbon atoms.

The tartrimides, tartramides or combinations thereof of the present invention may be prepared conveniently by reacting tartaric acid or a reactive equivalent of the tartaric acid (such as an ester, acid halide, or anhydride) with one or more of the corresponding amines by a well-known condensation process.

The alcohols useful for preparing the tartrates will similarly contain 1 or 8 to 30 or to 150 carbon atoms, that is, 1-150 or 8-30 or 1-30 or 8-150 atoms. Other alcohols may be employed within a range having a lower carbon number of 2, 3, 4, 6, 10, or 12 carbon atoms and an upper carbon number of 120, 80, 48, 24, 20, 18, or 16 carbon atoms. In certain embodiments the number of carbon atoms in the alcohol-derived group may be 8-24 or 10-18 or 12 to 16, or 13. The alcohols employed may be linear or branched, and, if branched, the branching may occur at any point in the chain and the branching may be of any length.

It is believed that using alcohols of at least 6 carbon atoms will lead to products having reduced volatility compared with those products prepared from shorter chain alcohols. It is also believed that using alcohols having at least one branch will promote solubility of the product in oil. Accordingly, certain embodiments of the invention employ the product prepared from branched alcohols of at least 6 carbon atoms, for instance, branched $C_{6-18}$ or $C_{8-18}$ alcohols or branched $C_{12-16}$ alcohols, either as single materials or as mixtures. Such branched alcohols may provide maximum solubility and compatibility in an oil. Specific examples include 2-ethylhexanol and isotrideyl alcohol, the latter of which may represent a commercial grade mixture of various isomers. Also, certain embodiments of the invention employ the product prepared from linear alcohols of at least 6 carbon atoms, for instance, linear $C_{6-18}$ or $C_{8-18}$ alcohols or linear $C_{12-16}$ alcohols, either as single materials or as mixtures. Such linear alcohols my provide optimal friction performance to an oil.

The tartrates of the present invention may be prepared conveniently by reacting tartaric acid or a reactive equivalent of the tartaric acid (such as an ester, acid halide, or anhydride) with one or more of the corresponding alcohols by a well-known condensation process.

Likewise, the alkyl groups of the amines may similarly be linear or branched.

The tartaric acid used for preparing the tartrates, tartrimides, or tartramides of the invention can be the commercially available type (obtained from Sargent Welch), and it is likely to exist in one or more isomeric forms such as d-tartaric acid, l-tartaric acid or mesotartaric acid, often depending on the source (natural) or method of synthesis (e.g. from maleic acid). These derivatives can also be prepared from functional equivalents to the diacid readily apparent to those skilled in the art, such as esters, acid chlorides, anhydrides, etc.

The tartrates, tartrimides, tartramides or combinations thereof of the present invention can be solids, semi-solids, or oils depending on the particular alcohol or amine used in preparing the tartrate, tartrimide, or tartramides. For use as additives in oleaginous compositions including lubricating and fuel compositions the tartrates, tartrimides, or tartramides are advantageously soluble and/or stably dispersible in such oleaginous compositions. Thus, for example, compositions intended for use in oils are typically oil-soluble and/or stably dispersible in an oil in which they are to be used. The term "oil-soluble" as used in this specification and appended claims does not necessarily mean that all the compositions in question are miscible or soluble in all proportions in all oils. Rather, it is intended to mean that the composition is soluble in an oil (mineral, synthetic, etc.) in which it is intended to function to an extent which permits the solution to exhibit one or more of the desired properties. Similarly, it is not necessary that such "solutions" be true solutions in the strict physical or chemical sense. They may instead be micro-emulsions or colloidal dispersions which, for the purpose of this invention, exhibit properties sufficiently close to those of true solutions to be, for practical purposes, interchangeable with them within the context of this invention.

As previously indicated, the tartrates, tartrimides, tartramides or combinations thereof compositions of this invention are useful as additives for lubricants, in which they may function as rust and corrosion inhibitors, friction modifiers, antiwear agents and demulsifiers. They can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines, and the like. Automatic transmission fluids, transaxle lubricants, gear lubricants, metalworking lubricants, hydraulic fluids and other lubricating oil and grease compositions can also benefit from the incorporation therein of the compositions of the present invention.

Other friction modifiers maybe present in the lubricants of the present invention and can include esters of polyols such as glycerol monooleates; oleyl amides; diethanol fatty amines and mixtures thereof. A useful list of friction modifiers is included in U.S. Pat. No. 4,792,410.

Esters of polyols include fatty acid esters of glycerol. These can be prepared by a variety of methods well known in the art. Many of these esters, such as glycerol monooleate and glycerol monotallowate, are manufactured on a commercial scale. The esters useful for this invention are oil-soluble and are preferably prepared from $C_8$ to $C_{22}$ fatty acids or mixtures thereof such as are found in natural products. The fatty acid may be saturated or unsaturated. Certain compounds found in acids from natural sources may include licanic acid which contains one keto group. Useful $C_8$ to $C_{22}$ fatty acids are those of the formula R—COOH wherein R is alkyl or alkenyl.

The fatty acid monoester of glycerol is useful. Mixtures of mono and diesters may be used. Mixtures of mono- and diester can contain at least about 40% of the monoester. Mixtures of mono- and diesters of glycerol containing from about 40% to about 60% by weight of the monoester can be used. For example, commercial glycerol monooleate containing a mixture of from 45% to 55% by weight monoester and from 55% to 45% diester can be used.

Useful fatty acids are oleic, stearic, isostearic, palmitic, myristic, palmitoleic, linoleic, lauric, linolenic, and eleostearic, and the acids from the natural products tallow, palm oil, olive oil, peanut oil.

Although tartrates and esters of polyols such as glycerol monooleate may appear to have superficially similar molecular structures, it is observed that certain combinations of these materials may actually provide better performance, e.g., in wear prevention, than either material used alone.

Fatty acid amides have been discussed in detail in U.S. Pat. No. 4,280,916. Suitable amides are $C_8$-$C_{24}$ aliphatic monocarboxylic amides and are well known. Reacting the fatty acid base compound with ammonia produces the fatty amide. The fatty acids and amides derived therefrom may be either saturated or unsaturated. Important fatty acids include lauric $C_{12}$, palmitic $C_{16}$ and steric $C_{18}$. Other important unsaturated fatty acids include oleic, linoleic and linolenic acids, all of which are $C_{18}$. In one embodiment, the fatty amides of the instant invention are those derived from the $C_{18}$ unsaturated fatty acids.

The fatty amines and the diethoxylated long chain amines such as N,N-bis-(2-hydroxyethyl)-tallowamine themselves are generally useful as components of this invention. Both types of amines are commercially available. Fatty amines and ethoxylated fatty amines are described in greater detail in U.S. Pat. No. 4,741,848

Miscellaneous

Antioxidants (that is, oxidation inhibitors), including hindered phenolic antioxidants such as 2,6-di-t-butylphenol, and hindered phenolic esters such as the type represented by the following formula:

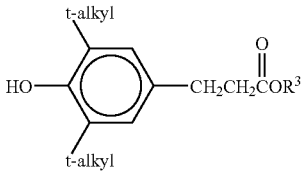

and in a specific embodiment,

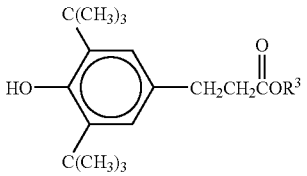

wherein $R^3$ is a straight chain or branched chain alkyl group containing 2 to 10 carbon atoms, in one embodiment 2 to 4, and in another embodiment 4 carbon atoms. In one embodiment, $R^3$ is an n-butyl group. In another embodiment $R^3$ can be 8 carbons, as found in Irganox L-135™ from Ciba. The preparation of these antioxidants can be found in U.S. Pat. No. 6,559,105.

Further antioxidants can include secondary aromatic amine antioxidants such as dialkyl (e.g., dinonyl) diphenylamine, sulfurized phenolic antioxidants, oil-soluble copper compounds, phosphorus-containing antioxidants, molybdenum compounds such as the Mo dithiocarbamates, organic sulfides, disulfides, and polysulfides (such as sulfurized Diels Alder adduct of butadiene and butyl acrylate). An extensive list of antioxidants is found in U.S. Pat. No. 6,251,840.

The EP/antiwear agent used in connection with the present invention is typically in the form of a zinc dialkyldithiophosphate. Although there are an extremely large number of different types of antiwear agents which might be utilized in connection with such functional fluids, the present inventors have found that zinc dialkyldithiophosphate type antiwear agents work particularly well in connection with the other components to obtain the desired characteristics. In one embodiment, at least 50% of the alkyl groups (derived from the alcohol) in the dialkyldithiophosphate are secondary groups, that is, from secondary alcohols. In another embodiment, at least 50% of the alkyl groups are derived from isopropyl alcohol.

Ashless detergents and dispersants depending on their constitution may upon combustion yield a non-volatile material such as boric oxide or phosphorus pentoxide. However, ashless detergents and dispersants do not ordinarily contain metal and therefore do not yield a metal-containing ash on combustion. Many types of ashless dispersants are known in the art. Such materials are commonly referred to as "ashless" even though they may associate with a metal ion from another source in situ.

(1) "Carboxylic dispersants" are reaction products of carboxylic acylating agents (acids, anhydrides, esters, etc.) containing at least 34 and preferably at least 54 carbon atoms which are reacted with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imide, amide, and ester reaction products of carboxylic ester dispersants.

The carboxylic acylating agents include fatty acids, isoaliphatic acids (e.g. 8-methyl-octadecanoic acid), dimer acids, addition dicarboxylic acids 4+2 and 2+2 addition products of an unsaturated fatty acid with an unsaturated carboxylic reagent), trimer acids, addition tricarboxylic acids (Empol® 1040, Hystrene® 5460 and Unidyme® 60), and hydrocarbyl substituted carboxylic acylating agents (from olefins and/or polyalkenes). In one embodiment, the carboxylic acylating agent is a fatty acid. Fatty acids generally contain from 8 up to 30, or from 12 up to 24 carbon atoms. Carboxylic acylating agents are taught in U.S. Pat. Nos. 2,444,328, 3,219,666, 4,234,435 and 6,077,909.

The amine may be a mono- or polyamine. The monoamines generally have at least one hydrocarbyl group containing from 1 to 24 carbon atoms, or from 1 to 12 carbon atoms. Examples of monoamines include fatty (C8-30) amines (Armeens™), primary ether amines (SURFAM® amines), tertiary-aliphatic primary amines (Primenes™), hydroxyamines (primary, secondary or tertiary alkanol amines), ether N-(hydroxyhydrocarbyl) amines, and hydroxyhydrocarbyl amines (Ethomeens™ and Propomeens™). The polyamines include alkoxylated diamines (Ethoduomeens™), fatty diamines (Duomeens™), alkylenepolyamines (ethylenepolyamines), hydroxy-containing polyamines, polyoxyalkylene polyamines (Jeffamines™), condensed polyamines (a condensation reaction between at least one hydroxy compound with at least one polyamine reactant containing at least one primary or secondary amino group), and heterocyclic polyamines. Useful amines include those disclosed in U.S. Pat. No. 4,234,435 (Meinhart) and U.S. Pat. No. 5,230,714 (Steckel).

The polyamines from which the dispersant is derived include principally alkylene amines conforming, for the most part, to the formula

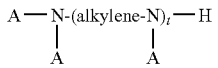

wherein t is an integer typically less than 10, A is hydrogen or a hydrocarbyl group typically having up to 30 carbon atoms, and the alkylene group is typically an alkylene group having less than 8 carbon atoms. The alkylene amines include principally methylene amines, ethylene amines, hexylene amines, heptylene amines, octylene amines, other polymethylene amines. They are exemplified specifically by: ethylene diamine, diethylene triamine, triethylene tetramine, propylene diamine, decamethylene diamine, octamethylene diamine, di(heptamethylene) triamine, tripropylene tetramine, tetraethylene pentamine, trimethylene diamine, pentaethylene hexamine, di(-trimethylene) triamine. Higher homologues such as are obtained by condensing two or more of the above-illustrated alkylene amines likewise are useful. Tetraethylene pentamines is particularly useful.

The ethylene amines, also referred to as polyethylene polyamines, are especially useful. They are described in some detail under the heading "Ethylene Amines" in Encyclopedia of Chemical Technology, Kirk and Othmer, Vol. 5, pp. 898-905, Interscience Publishers, New York (1950).

Hydroxyalkyl-substituted alkylene amines, i.e., alkylene amines having one or more hydroxyalkyl substituents on the nitrogen atoms, likewise are useful. Examples of such amines include N-(2-hydroxyethyl)ethylene diamine, N,N'-bis(2-hydroxyethyl)-ethylene diamine, 1-(2-hydroxyethyl)piperazine, monohydroxypropyl)-piperazine, di-hydroxypropy-substituted tetraethylene pentamine, N-(3-hydroxypropyl)-tetra-methylene diamine, and 2-heptadecyl-1-(2-hydroxyethyl)-imidazoline.

Higher homologues, such as are obtained by condensation of the above-illustrated alkylene amines or hydroxy alkyl-substituted alkylene amines through amino radicals or through hydroxy radicals, are likewise useful. Condensed polyamines are formed by a condensation reaction between at least one hydroxy compound with at least one polyamine reactant containing at least one primary or secondary amino group and are described in U.S. Pat. Nos. 5,230,714 and 5,296,154 (Steckel).

Examples of these "carboxylic dispersants" are described in British Patent 1,306,529 and in many U.S. Patents including the following: U.S. Pat. Nos. 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, 6,077,909 and 6,165,235.

(2) Succinimide dispersants are a species of carboxylic dispersants. They are the reaction product of a hydrocarbyl substituted succinic acylating agent with an organic hydroxy compound or, an amine containing at least one hydrogen attached to a nitrogen atom, or a mixture of said hydroxy compound and amine. The term "succinic acylating agent" refers to a hydrocarbon-substituted succinic acid or succinic acid-producing compound (which term also encompasses the acid itself). Such materials typically include hydrocarbyl-substituted succinic acids, anhydrides, esters (including half esters) and halides.

Succinic based dispersants have a wide variety of chemical structures including typically structures such as

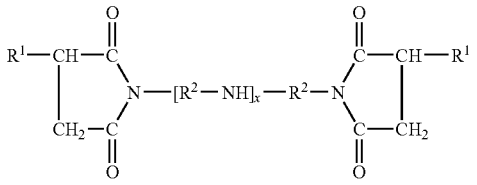

In the above structure, each $R^1$ is independently a hydrocarbyl group, such as a polyolefin-derived group having an $\overline{M}_n$ of 500 or 700 to 10,000. Typically the hydrocarbyl group is an alkyl group, frequently a polyisobutyl group with a molecular weight of 500 or 700 to 5000, or alternatively 1500 or 2000 to 5000. Alternatively expressed, the $R^1$ groups can contain 40 to 500 carbon atoms, for instance at least 50, e.g., 50 to 300 carbon atoms, such as aliphatic carbon atoms. The $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Succinimide dispersants are more fully described in U.S. Pat. Nos. 4,234,435, 3,172,892 and 6,165,235.

The polyalkenes from which the substituent groups are derived are typically homopolymers and interpolymers of polymerizable olefin monomers of 2 to 16 carbon atoms; usually 2 to 6 carbon atoms. The amines which are reacted with the succinic acylating agents to form the carboxylic dispersant composition can be monoamines or polyamines as described above.

The succinimide dispersant is referred to as such since it normally contains nitrogen largely in the form of imide functionality, although it may be in the form of amine salts, amides, imidazolines as well as mixtures thereof. To prepare the succinimide dispersant, one or more of the succinic acid-producing compounds and one or more of the amines are heated, typically with removal of water, optionally in the presence of a normally liquid, substantially inert organic liquid solvent/diluent at an elevated temperature, generally in the range of 80° C. up to the decomposition point of the mixture or the product; typically 100° C. to 300° C.

Additional details and examples of the procedures for preparing the succinimide dispersants of the present invention are included in, for example, U.S. Pat. Nos. 3,172,892, 3,219,666, 3,272,746, 4,234,435, 6,440,905 and 6,165,235.

(3) "Amine dispersants" are reaction products of relatively high molecular weight aliphatic halides and amines, preferably polyalkylene polyamines. Examples thereof are described, for example, in the following U.S. Pat. Nos. 3,275,554, 3,438,757, 3,454,555, and 3,565,804.

(4) "Mannich dispersants" are the reaction products of alkyl phenols in which the alkyl group contains at least 30 carbon atoms with aldehydes (especially formaldehyde) and amines (especially polyalkylene polyamines). The materials described in the following U.S. Patents are illustrative: U.S. Pat. Nos. 3,036,003, 3,236,770, 3,414,347, 3,448,047, 3,461,172, 3,539,633, 3,586,629, 3,591,598, 3,634,515, 3,725,480, 3,726,882, and 3,980,569.

(5) Post-treated dispersants are obtained by reacting carboxylic, amine or Mannich dispersants with reagents such as dimercaptothiadiazoles, urea, thiourea, carbon disulfide, aldehydes, ketones, carboxylic acids, hydrocarbon-substituted succinic anhydrides, nitriles epoxides, boron compounds, phosphorus compounds or the like. Exemplary materials of this kind are described in the following U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422.

(6) Polymeric dispersants are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Examples of polymer dispersants thereof are disclosed in the following U.S. Pat. Nos. 3,329,658, 3,449,250, 3,519,656, 3,666,730, 3,687,849, and 3,702,300.

The composition can also contain one or more detergents, which are normally salts, and specifically overbased salts. Overbased salts, or overbased materials, are single phase, homogeneous Newtonian systems characterized by a metal content in excess of that which would be present according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (such as mineral oil, naphtha, toluene, xylene) for said acidic organic material, a stoichiometric excess of a metal base, and a promoter.

The acidic organic compounds useful in making the overbased compositions of the present invention include carboxylic acids, sulfonic acids, phosphorus-containing acids, phenols or mixtures thereof. Preferably, the acidic organic compounds are carboxylic acids or sulfonic acids with sulfonic or thiosulfonic groups (such as hydrocarbyl-substituted benzenesulfonic acids), and hydrocarbyl-substituted salicylic acids. Another type of compound useful in making the overbased composition of the present invention is salixarates. A description of the salixarates useful for of the present invention can be found in publication WO 04/04850.

The metal compounds useful in making the overbased salts are generally any Group 1 or Group 2 metal compounds (CAS version of the Periodic Table of the Elements). The Group 1 metals of the metal compound include Group 1a alkali metals (e.g., sodium, potassium, lithium) as well as Group 1b metals such as copper. The Group 1 metals are preferably sodium, potassium, lithium and copper, preferably sodium or potassium, and more preferably sodium. The Group 2 metals of the metal base include the Group 2a alkaline earth metals (e.g., magnesium, calcium, strontium, barium) as well as the Group 2b metals such as zinc or cadmium. Preferably the Group 2 metals are magnesium, calcium, barium, or zinc, preferably magnesium or calcium, more preferably calcium.

Examples of the overbased detergent of the present invention include, but are not limited to calcium sulfonates, calcium phenates, calcium salicylates, calcium salixarates and mixtures thereof.

The amount of the overbased material, that is, the detergent, if present, is in one embodiment 0.05 to 3 percent by weight of the composition, or 0.1 to 3 percent, or 0.1 to 1.5 percent, or 0.15 to 1.5 percent by weight.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125-162.

The compositions of the present invention are employed in practice as lubricants by supplying the lubricant to an internal combustion engine (such as a stationary gas-powered internal combustion engine) in such a way that during the course of operation of the engine the lubricant is delivered to the critical parts of the engine, thereby lubricating the engine.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

The invention will be further illustrated by the following examples, which set forth particularly advantageous embodiments. While the examples are provided to illustrate the present invention, they are not intended to limit it.

The lubricants are evaluated in the Sequence VIB fuel economy test as defined by the ILSAC GF-4 specification for fuel economy and durability.

The following formulations are prepared in an oil of lubricating viscosity, where the amounts of the additive components are in percent by weight, including conventional diluent oil.

TABLE I

| | Example | | |
|---|---|---|---|
| | C1 | C2 | Ex. 3 |
| Succinimide dispersant | 5.1 | 5 | 5 |
| Zinc dialkyldithiophosphate | 0.84 | 0.86 | 0.86 |
| Antioxidants | 2.44 | 2.2 | 2.2 |
| Pour Point Depressant | 0 | 0 | 0.3 |
| Overbased calcium sulfonate detergent(s) | 1.53 | 1.53 | 1.53 |
| Viscosity Index Improver | 8.15 | 8.15 | 8 |
| Alkyl Borate | 0 | 0.05 | 0.05 |
| Friction Modifier | 0 | 0.1 | 0.1 |
| Glycerol monooleate | n.p | 0.4 | n.p. |
| Oleylamine Tartrimide | n.p. | n.p. | 0.5 |
| Sequence VIB Engine | | | |
| Initial Fuel Economy (passing ≧ 1.5) | 1.5 | 1.8 | 1.9 |
| Durability (passing ≧ 1.5) | 1.2 | 1.4 | 1.9 |

*n.p. = not present in the formulation

The results show that formulations using oleylamine tartrimide in a low sulfur, ash and phosphorous crankcase lubricant significantly improves fuel economy compared to formulations using glycerol monooleate, a conventional friction modifier, as demonstrated in the Sequence VIB engine test.

The lubricants are further evaluated in the 4 Ball Low Phosphorous/Sulfur (4 Ball Low PS) test, High Frequency Reciprocating Rig 1% cumene hydroperoxide (HFRR 1% CHP) test and the Cameron-Plint High Temperature Reciprocating Wear test for wear and friction reduction.

The 4 Ball Low PS procedure utilizes the same test conditions as ASTM D4172 with the addition of cumene hydroperoxide (CHP) as a lubricant pre-stress. The basic operation of the four ball wear test can be described as three stationary 0.5 diameter steel ball bearings locked in a triangle pattern. A fourth steel ball bearing is loaded against and rotated against the three stationary balls. The wear scar is measured on each of the three stationary balls using a microscope and averaged to determine the average wear scar diameter in millimeters.

The HFRR 1% CHP test is used to evaluated the friction and wear performance of lubricants containing reduced levels of phosphorous and sulfur. The wear scar diameter and percent film thickness by using a reciprocating steel ball bearing which slides against a flat steel plate is measured. This test is run using 1% cumene hydroperoxide (CHP) in conjunction with the High Frequency Reciprocating Wear Rig, which is a commercially available piece of tribology test equipment.

The Cameron-Plint High Temperature Reciprocating Wear test is used to evaluate the friction and wear performance of lubricants. The wear scar diameter and percent film thickness are obtained by using a reciprocating steel ball bearing which slides against a flat steel plate is measure. This test is run using the Cameron-Plint Reciprocating Wear Rig, which is a commercially available piece of tribology test equipment.

The following formulations are prepared in an oil of lubricating viscosity, where the amounts of the additive components are in percent by weight, unless indicated otherwise: 0.15% pour point depressant (including about 35% diluent oil), 8% viscosity index improver (including about 91% diluent oil), 0.89% diluent oil, 5.1% succinimide dispersant (including about 47% diluent oil), 0.48% zinc dialkyldithiophosphate (except for C3, which contains 0.98%) (each including about 9% diluent oil), 1.53% overbased calcium sulfonate detergent (including about 42% diluent oil), 0.1% glycerol monooleate (including about 0% diluent oil), antioxidants (including about 5% diluent oil), 90-100 ppm of a commercial defoamer, and the remainder base oil.

To the above formulation are added the components, as found in the following table and run in the 4 Ball Low PS test, the High Frequency Reciprocating Rig 1% Cumene Hydroperoxide test and the Cameron-Plint High Temperature Reciprocating Wear test. The results are found in the table below.

The results show that formulations using tartaric acid derived compounds of the present invention in a low sulfur, ash and phosphorous lubricant (Ex. 5-10) reduce wear compared to low SAPS formulation with 0.05 percent by weight of phosphorus delivered to the composition (C4), which do not contain tartaric acid derived compounds. They further provide equivalent wear protection compared to conventional GF-3 formulations (C3), which has higher phosphorous.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

TABLE II

| | C3 0.1% P | C4 0.05% P | Ex. 5 0.05% P | Ex. 6 0.05% P | Ex. 7 0.05% P | Ex. 8 0.05% P | Ex. 9 0.05% P | Ex. 10 0.05% P |
|---|---|---|---|---|---|---|---|---|
| Additional Component: | | | | | | | | |
| [1,3]Dioxolane C12-14 Alkyl Tartrate Ester | | | 0.5 | | | | | |
| Oleyl Tartrimide | | | | 0.5 | | | | |
| Oleyl Tartrimide | | | | | 1 | | | |
| Branched C13 Alkyl Tartrate Ester | | | | | | 1 | | |
| TriDecylPropoxyAmine Tartrimide | | | | | | | 1 | |
| Borated TriDecyl-PropoxyAmine Tartrimide | | | | | | | | 1 |
| Test: | | | | | | | | |
| 1. 4 Ball Low PS Test | | | | | | | | |
| Average Scar Diameter (mm) | 0.59 | 0.61, 0.77 | 0.51 | 0.7 | n.r. | n.r. | 0.45 | 0.41 |
| 2. HFRR 1% CHP Test | | | | | | | | |
| Wear Scar Diameter (μm) | 161, 185 | 285, 295, 435 | 236 | 251 | 260 | 286 | 297 | 183 |
| Film Thickness (%) | 94, 83 | 1, 1, 23 | 86 | 66 | 58 | 56 | 97 | 50 |
| 3. Cameron-Plint High Temperature Reciprocating Wear Test | | | | | | | | |
| Wear Scar Diameter (μm) | 339 | 661 | n.r. | n.r. | 375 | 352 | n.r. | n.r. |
| Film Thickness (%) | 100 | 62 | n.r. | n.r. | 100 | 99 | n.r. | n.r. |

Note:
n.r. = not reported

What is claimed is:

1. A lubricant composition comprising:

(a) an oil of lubricating viscosity, and (b) a tartrate derived from a material represented by formula I and an alcohol having about 8 to about 30 carbon atoms and combinations thereof;

I

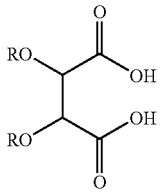

wherein each R is independently H, or a hydrocarbyl group, or wherein the R groups together form a ring; and wherein if R is H, said tartrate is optionally further functionalized by acylation or reaction with a boron compound; and (c) an additional friction modifier other than component (b);

wherein said lubricant composition has a sulfated ash value of up to about 1.0, a phosphorus content of up to about 0.08 percent by weight and a sulfur content of up to about 0.4 percent by weight; and wherein the amount of said tartrate is about 0.1 to 5.0 percent by weight of said lubricating composition.

2. The composition of claim 1, wherein component (c), the additional friction modifier, is present from at least 0.1 percent by weight.

3. The composition of claim 2, wherein the amount of said tartrate is about 0.1 to about 2.0 percent by weight.

4. The composition of claim 2, wherein the amount of said tartrate is about 0.25 to about 1.25 percent by weight.

5. The composition of claim 1, further comprising a metal dialkyldithiophosphate.

6. The composition of claim 5, wherein the metal dialkyldithiophosphate is zinc dialkyldithiophosphate wherein at least about 50 percent of the alkyl groups thereof are secondary alkyl groups.

7. The composition of claim 1, further comprising a dispersant.

8. The composition of claim 7, wherein the dispersant is a succinimide.

9. The composition of claim 1, further comprising at least one calcium overbased detergent.

10. The composition of claim 9, wherein the calcium overbased detergent is selected from the group consisting of calcium sulfonates, calcium phenates, calcium salicylates, calcium salixarates and mixtures thereof.

11. The composition of claim 1, further comprising at least one antioxidant.

12. The composition of claim 11, wherein the antioxidant is selected from the group consisting of hindered phenols, aryl amines and mixtures thereof.

13. The composition of claim 1 wherein the additional friction modifiers are selected from the group consisting of glycerol monooleates, oleyl amides, diethanol fatty amines and mixtures thereof.

14. The composition of claim 1, further comprising a defoamer.

15. A method of lubricating an internal combustion engine, comprising supplying to said engine a lubricant composition comprising (a) an oil of lubricating viscosity, and (b) a tartrate derived from a material represented by formula I and an alcohol having about 8 to about 30 carbon atoms and combinations thereof;

I

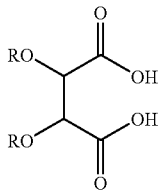

wherein each R is independently H or a hydrocarbyl group, or wherein the R groups together form a ring; or wherein if R is H, then the resulting hydroxyl group is optionally further functionalized by acylation or reaction with a boron compound; and (c) an additional friction modifier other than component (b);

wherein said lubricant composition has a sulfated ash value of up to about 1.0, a phosphorus content of up to about 0.08 percent by weight and a sulfur content of up to about 0.4 percent by weight; and wherein the amount of said tartrate is about 0.1 to 5.0 percent by weight of said lubricating composition.

16. A method of making a lubricant composition comprising:

(i) blending (a) an oil of lubricating viscosity and (b) a tartrate derived from a material represented by formula I and an alcohol having about 8 to about 30 carbon atoms and combinations thereof;

I

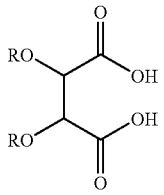

wherein in the product each R is independently H or a hydrocarbyl group, or wherein the R groups together form a ring; or wherein if R is H, then the resulting hydroxyl group is optionally further functionalized by acylation or reaction with a boron compound; and (c) an additional friction modifier other than component (b);

resulting in a lubricant composition wherein said lubricant composition has a sulfated ash value of up to about 1.0, a phosphorus content of up to about 0.08 percent by weight and a sulfur content of up to about 0.4 percent by weight; and wherein the amount of said tartrate is about 0.1 to 5.0 percent by weight of said lubricating composition.

17. The composition of claim 1 wherein component (b) is the product of a condensation reaction with an alcohol.

18. The composition of claim 17 wherein the alcohol is a branched alcohol of 8 to about 18 carbon atoms.

19. The composition of claim 17 wherein the alcohol is a linear alcohol of 8 to about 18 carbon atoms.

20. The composition of claim 18 wherein component (b) is a branched $C_{12-16}$-alkyl tartrate ester.

21. The composition of claim 19 wherein component (b) is a linear $C_{12-16}$-alkyl tartrate ester.

22. The composition of claim 1 wherein the additional friction modifier is an ester of a polyol.

23. The composition of claim 22 wherein the ester of a polyol comprises glycerol monooleate.

24. The method of claim 15 wherein component (b) is the product of condensation with an alcohol.

25. The method of claim 24 wherein the alcohol comprises a branched alcohol of 8 to about 18 carbon atoms.

26. The method of claim 24 wherein the alcohol comprises a linear alcohol of 8 to about 18 carbon atoms.

27. The method of claim 24 wherein the additional friction modifier comprises glycerol monooleate.

28. The composition of claim 1 further comprising a molybdenum compound.

29. The method of claim 15 wherein said lubricant composition further comprises a molybdenum compound.

30. The method of claim 16 wherein said lubricant composition further comprises a molybdenum compound.

* * * * *